US007722786B2

(12) United States Patent
Bao et al.

(10) Patent No.: US 7,722,786 B2
(45) Date of Patent: May 25, 2010

(54) CONDUCTIVE MATERIALS

(75) Inventors: Lirong Bao, Hillsborough, NJ (US); Allison Xiao, Belle Mead, NJ (US); Bin Wei, Matawan, NJ (US)

(73) Assignee: Henkel AG & Co. KGaA, Duesseldorf (DE)

( * ) Notice: Subject to any disclaimer, the term of this patent is extended or adjusted under 35 U.S.C. 154(b) by 69 days.

(21) Appl. No.: 11/678,140

(22) Filed: Feb. 23, 2007

(65) Prior Publication Data

US 2008/0202380 A1 Aug. 28, 2008

(51) Int. Cl.
*H01B 1/00* (2006.01)
*H01B 1/22* (2006.01)

(52) U.S. Cl. ..... 252/500; 252/514

(58) Field of Classification Search ..... 252/500, 252/514

See application file for complete search history.

(56) References Cited

U.S. PATENT DOCUMENTS

| | | | | |
|---|---|---|---|---|
| 5,565,143 | A * | 10/1996 | Chan | 252/514 |
| 5,672,297 | A * | 9/1997 | Soane | 252/511 |
| 6,991,750 | B2 * | 1/2006 | Majumdar et al. | 252/500 |
| 7,026,382 | B2 * | 4/2006 | Akiba et al. | 524/268 |
| 2003/0035956 | A1 * | 2/2003 | Hisashi et al. | 428/408 |
| 2005/0214480 | A1 | 9/2005 | Garbar et al. | |
| 2005/0215689 | A1 | 9/2005 | Garbar et al. | |
| 2005/0238804 | A1 | 10/2005 | Garbar et al. | |

FOREIGN PATENT DOCUMENTS

| | | |
|---|---|---|
| WO | WO 2004005413 | 1/2004 |
| WO | WO 2004097853 | * 11/2004 |
| WO | WO 2006030286 | 3/2006 |

OTHER PUBLICATIONS

Spires et al., High Resolution TEM Obsevations of Single-Walled Carbon Nanotubes, http://www.botany.utexas.edu/facstaff/facpages/mbrown/ongres/tspires/nano.htm.*

Da He and N.N. Ekere, "Effects of Particle Size Ratio on the Conducting Percolation Threshold . . . ", Journal of Physics D: Applied Physics, 37 (2004) 1848-1852.

Dufresne A. et al. "Processing and characterization of carbon nanotube/poly(styrene-co-butyl acrylate) nanocomposites", Journal of Materials Science, Springer/Business Media, Dordrecht, NL, vol. 37, No. 18, Jan. 1, 2002, pp. 3915-3923.

(Continued)

*Primary Examiner*—Mark Kopec
*Assistant Examiner*—Jaison P Thomas
(74) *Attorney, Agent, or Firm*—Jane E. Gennaro

(57) ABSTRACT

A material for producing a conductive composition comprising polymer particles, conductive particles, and a liquid medium. The material is in a liquid/dispersion form until it is cured at which time it forms an electrically conductive composition. The composition contains larger sized polymer particles along with smaller metal conductive filler particles such as nanoparticle-sized filler particles. The larger polymer particles create excluded volume in the material matrix and reduce the percolation threshold of the conductive filler particles to provide a conductive material with a reduced volume fraction of electrically conductive filler. The electrical conductivity of the material is further increased after heat treatment which causes the conductive filler particles to sinter together to form a highly conductive network.

8 Claims, 3 Drawing Sheets

OTHER PUBLICATIONS

Gabrielson L et al. "Manufacture of colloidal polymer ellipsoids for anisotropic conducting nano-composites", Journal of Materials Science, Kluwer Academic Publishers, Bo., vol. 36, No. 1, Jan. 1, 2001, pp. 1-6.

Bridge, Folkes, Wood "Investigation into DC conductivity of colloidally dispersed gold/polymer composites", Journal of Physics D: Applied Physics, vol. 23, 1990, pp. 890-898.

* cited by examiner

CONDUCTIVE MATERIALS

FIELD OF THE INVENTION

The present invention relates to conductive materials for use in electronic devices. The materials comprise polymer particles, conductive particles and a liquid medium which dissipates upon curing to provide a conductive film.

BACKGROUND OF THE INVENTION

Conductive materials are utilized in many different electronics applications. Such materials are commonly polymer-based and contain metal conductive fillers such as silver powder or silver flakes. After application and curing, the conductive metals form a percolated network within the polymer matrix, which provides the electrical conducting channels. Typical electronic coatings and conductive adhesives require conductive filler loadings which are very high, with the conductive filler often comprising about 70-85 weight percent of the composition due to a high percolation threshold. Such coatings and adhesive are frequently very expensive due to the high cost of conductive metals, which are usually the most expensive component in conductive compositions, as opposed to the relatively low cost of polymers. Consequently, it would be advantageous to provide a lower cost conductive composition with a reduced volume of metal conductive filler material.

SUMMARY OF THE INVENTION

The present invention is directed to a material for producing a conductive composition comprising polymer particles, conductive particles and a liquid medium. The material is in a liquid/emulsion form until it is cured at which time it forms an electrically conductive composition. The composition contains larger-sized polymer particles along with smaller metal or other conductive filler particles such as nanoparticle-sized filler particles. The larger polymer particles create excluded volume in the material matrix and reduce the percolation threshold of the conductive filler particles to provide a conductive material with a reduced volume fraction of electrically conductive filler. The electrical conductivity of the material is further increased after heat treatment which causes the metal conductive filler particles to sinter together to form a highly conductive network.

DETAILED DESCRIPTION OF THE PREFERRED EMBODIMENTS

Figure 1:
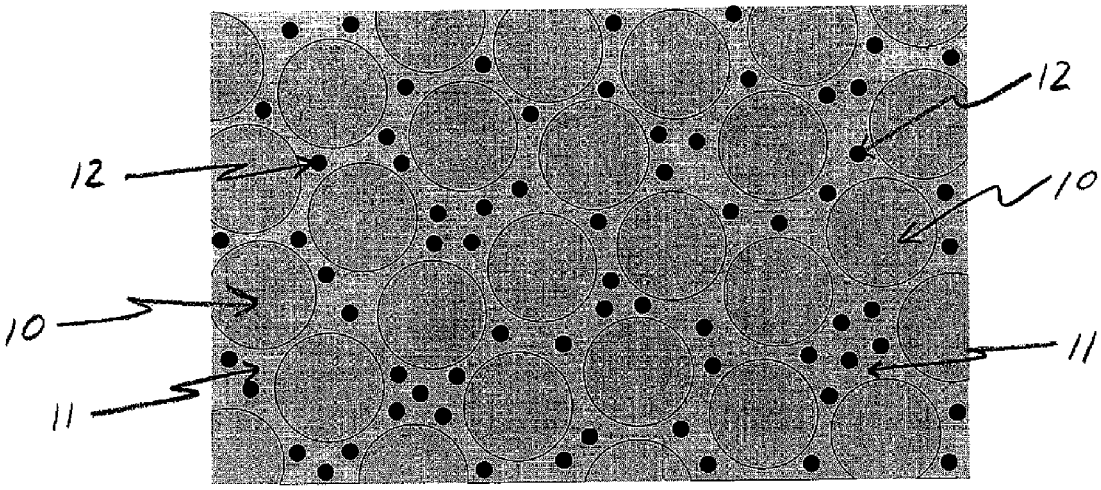
FIG. 1 is a schematic drawing of the packing of polymer particles and conductive filler particles in a liquid medium.

Percolated filler networks containing polymer materials in combination with conductive filler particles are commonly utilized in applications requiring electrical conductivity. Generally, the conductive filler materials are substantially more expensive than the polymer filler materials. Thus, for cost reasons, it is advantageous to minimize the amount of conductive filler material that is utilized in the network. In the situation where two particles of very different sizes are packed together, the percolation threshold of the smaller particles is significantly reduced. Thus, the use of larger sized polymer particles to create excluded volume between the particles reduces the amount of smaller sized conductive filler material needed to form a conductive network.

To form the network, conductive filler particles are used along with polymer emulsions containing polymer particles that are larger in size than the conductive filler particles. The average size of the conductive filler particles may vary and may be in the range of about 5 nanometers to about 5 microns in diameter. The size of the conductive particles must be such that they are smaller than the polymer particles and also capable of gathering together upon the application of heat, usually at a temperature greater than about 100° C., to form a conductive network. Preferably the conductive filler particles are less than about 500 nm in size and sinter together upon sufficient heating. Small metal particles, such as those in the nanoparticle range, have much lower sintering temperatures than micron-sized or bulk metal. For example, silver nanoparticles with a size of less than 500 nm sinter at a temperature of around 150° C., which enhances conductivity, while the bulk melting point of silver is 960° C. The sintering temperature of the composition varies depending upon the type, size and surface chemistry of the filler. Any sintering that occurs generally enhances the conductivity of the network. The average size of the polymer particles should be at least about 1.5 times larger than the size of the conductive filler particles so that the conductive filler/polymer particle size ratio is at least 1:1.5. Further embodiments have ratios of 1:5 and 1:20. Larger ratios may also be employed as desired.

One or more conductive fillers are utilized in the composition. Exemplary conductive fillers include, but are not limited to, silver, copper, gold, palladium, platinum, nickel, gold or silver-coated nickel, carbon black, lead, zinc, metal alloys, carbon fiber, graphite, aluminum, indium tin oxide, silver coated copper, silver oxide, silver coated aluminum, metallic coated glass spheres, metallic coated filler, metallic coated polymers, silver coated fiber, silver coated spheres, antimony doped tin oxide, conductive nanospheres, nano silver, nano aluminum, nano copper, nano nickel, carbon nanotubes and mixtures thereof. The polymer particle portion of the composition may comprise aqueous polymer emulsions or polymer particles dispersed in organic solvents. Preferred polymer particles are polymer latexes which decrease the percolation threshold of the conductive filler by deforming in response to heat and/or pressure to reduce the size of the interstitial spaces between the polymer particles.

One or more different polymers may be used in the composition. Exemplary polymers that may be utilized include polyvinyl acetate, ethylene vinyl acetate copolymers, acrylate, acrylic ester copolymers, styrene, styrene acrylate copolymers, polyurethane, rubber latexes, including natural rubber, butyl rubber and styrene butadiene rubber, and copolymers and mixtures thereof.

To produce a conductive network, the polymer particles are preferably in the form of an emulsion or dispersion which is compatible with the conductive fillers. In a preferred embodiment, the conductive filler is in a dispersion which, depending upon the carrier, is either directly added to the emulsion or dispersion or dried to produce a dry conductive filler powder that is added to the polymer emulsion or dispersion. The curable mixture is then coated on a substrate and cured via drying. During the drying process, the soft polymer emulsion particles coalesce to form a continuous film which initially provides poor electrical conductivity. Upon the application of heat to the film, the conductive filler particles form an electrically conductive network within the film. The heating temperature should be such that it is compatible with the processing temperature of the polymer that is used in the network. In order to maximize the compatibility of the conductive filler with the polymer which may be in emulsion form, the conductive filler should be in a dispersion with a solvent such as for example water, alcohol, or glycol.

Figure 2:
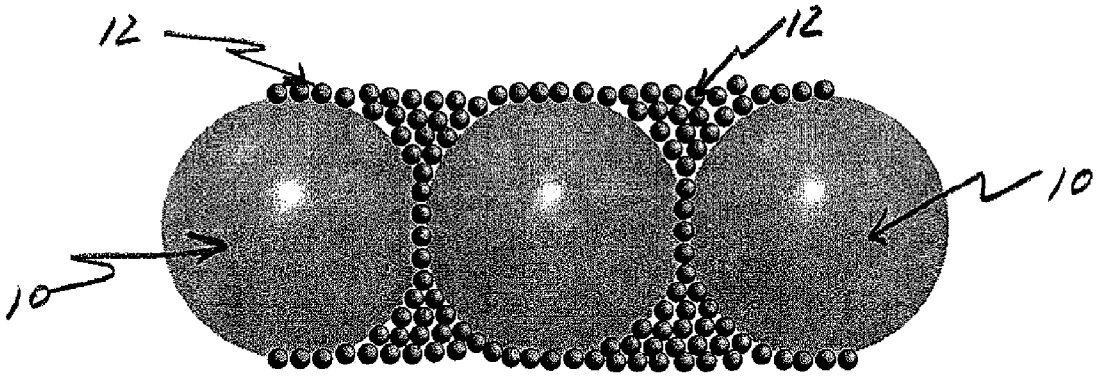
FIG. 2 is a schematic drawing of polymer particles and conductive filler particles after drying.
Figure 3:
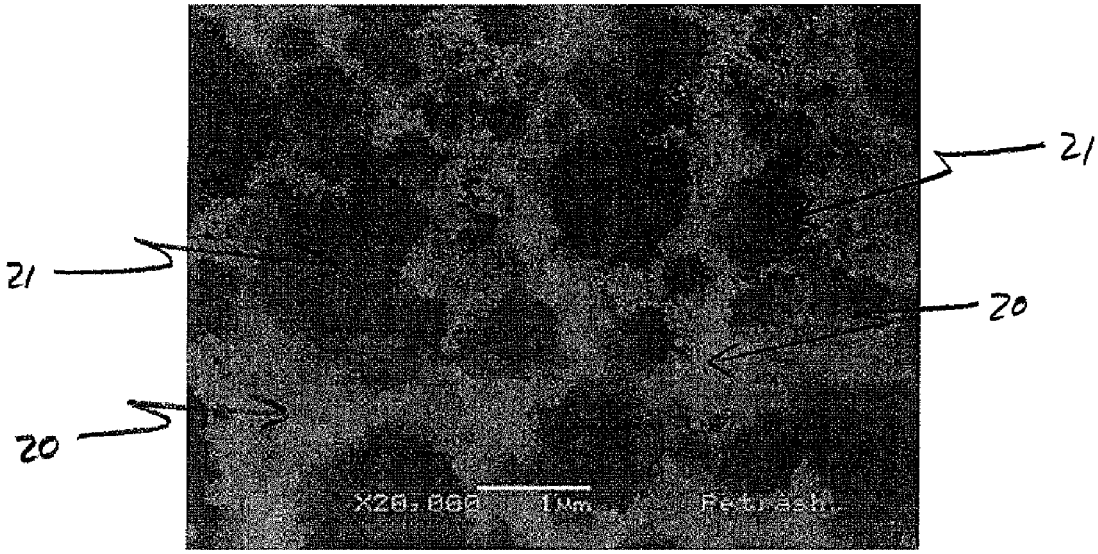
FIG. 3 is a scanning electron microscope photograph of a film formed according to the present invention

FIG. 1 illustrates an uncured emulsion network containing larger polymer particles 10 and smaller conductive filler particles 12 and a liquid medium. Interstitial areas 11 surround the larger polymer particles. As shown, the interstitial areas contain many smaller conductive filler particles. FIG. 2 illustrates the polymer and conductive filler network after drying and film formation. The large polymer particles 10 force the smaller conductive filler particles 12 into a percolated structure that will provide electrical conductivity. FIG. 3 is a scanning electron microscope photograph of the top surface of the cured film showing the conductive filler network 20 surrounding the polymer particles 21.

The composition of the present invention has utility in many different and varied electronics applications. Such applications include, but are not limited to, conductive inks for conductive tracks, electronic circuitry, radio frequency identification systems, and conductive coatings such as electromagnetic interference shielding and anti-static coatings. The composition of the present invention may provide transparent coatings in the situation where the size of the polymer particles before heating or polymer regions after heating are larger than the wavelength of visible light. Such transparent coatings would be advantageous in applications such as for electrodes in electroluminescent lamps and displays.

The invention can be further described by the following non-limiting examples.

Example 1. Compositions 1-4 were made by blending nanosilver, having an average particle size of about 60 nm, dispersions in isopropanol solvent with polyvinyl acetate emulsion having a solid content of 56% and a number average particle size of about 1.4 μm and a volume mean diameter 2.5 μm. The size ratio between the polymer number average particle size and silver particle size is about 23:1. The ingredients of each composition are shown in Table 1.

TABLE 1

Formulation of Compositions A–D

| | Formulation | | | |
|---|---|---|---|---|
| | 1 | 2 | 3 | 4 |
| Nanosilver powder[1] (g) | 0.97 | 1.22 | 2.03 | 2.36 |
| Polyvinyl Acetate Emulsion[2] (g) | 4.17 | 3.28 | 3.61 | 2.87 |
| Water (g) | 1.88 | 1.20 | 2.60 | 3.20 |
| Calculated Silver Content (%) | 29.4 | 39.9 | 50.1 | 59.5 |

[1]7000-95 Nanosilver, commercially available from Ferro Corporation
[2]Dur-O-Set C-325, commercially available from Celanese Corporation To produce the coatings, the nanosilver is first dried in a vacuum oven at room temperature to remove the isopropanol solvent and obtain a dry powder. The dried nanosilver powder is mixed with the polyvinyl acetate emulsion along with small amounts of deionized water to lower the viscosity. Ten grams of Zirconia milling beads (3 mm in diameter) were added to the mixture and the mixture was mixed with a FlackTek Speedmixer at 2700 rpm for two one-minute periods to obtain a smooth dark brown mixture. The mixture was then coated on 2 inch×3 inch glass slides using a drawdown bar with a 2 mil. gap. The coating was dried overnight at room temperature. The glass slides containing the dried coating were annealed in air at various temperatures for thirty minutes using convection ovens. The resistivity of the coatings after annealing was measured using the 4-point probe method and the silver content was measured using thermogravimetric analysis (TGA). To measure the silver content via TGA, a small amount of annealed film was removed from the glass slide and scanned in TGA at temperatures ranging from room temperature to 550° C. in air. Organic materials are burnt and removed during the TGA scan. The residual weight at 550° C. corresponds to the amount of silver in the film. Table 2 shows the annealing conditions, silver content and resistivity for samples 1-4 after annealing. The silver volume fraction was calculated by using the measured silver weight fraction and the density of silver (10.5 g/cm$^3$) and the density of the polymer (1.05 g/cm$^3$).

TABLE 2

Properties of Formulations A–D after Annealing

| Formulation | Annealing Conditions | Silver Content by TGA (%) | Silver Volume Fraction (%) | Resistivity (Ω · cm) |
|---|---|---|---|---|
| 1 | 150° C. | 27.2 | 3.60 | $1.6 \times 10^4$ |
| 1 | 170° C. | 27.2 | 3.60 | $9.2 \times 10^{-1}$ |
| 2 | 150° C. | 37.7 | 5.71 | $8.94 \times 10^{-2}$ |
| 2 | 170 | 37.7 | 5.71 | $2.85 \times 10^{-2}$ |
| 2 | 200° C. | 39.3 | 6.08 | $1.54 \times 10^{-3}$ |
| 2 | 230° C. | 45.4 | 7.68 | $6.51 \times 10^{-4}$ |
| 3 | 150° C. | 47.5 | 8.30 | $8.72 \times 10^{-3}$ |
| 3 | 170° C. | 47.5 | 8.30 | $1.97 \times 10^{-3}$ |
| 4 | 150° C. | 57.8 | 12.06 | $4.74 \times 10^{-3}$ |
| 4 | 170° C. (20 minutes) | 57.8 | 12.06 | $9.54 \times 10^{-4}$ |

As shown in Table 2, the combination of small silver particles and large polymer latex particles provides a material with good electrical conductivity, even with very low silver loading. Formulation 1 illustrates that measurable conductivity is achieved with only 27 weight percent silver which is 3.6 volume percent silver. Thus, the percolation threshold of the silver particles in this Example has been decreased to less than 3.6 volume percent of the composition. In contrast, calculated values utilizing various mathematical modeling procedures show the percolation threshold of spherical models in uniform media at about 15-30 volume percent.

Example 2. Three compositions were made according to the method of Example 1. Silver particles were utilized with an average particle size in the range of about 0.4 μm to about 1 μm resulting in a polymer particle/nanosilver particle size ratio of about 1.5:1 to about 3.5:1. The ingredients of each composition are shown in Table 3.

TABLE 3

Formulation of Compositions 5–7

| | Formulation | | |
|---|---|---|---|
| | 5 | 6 | 7 |
| Micro silver Powder[1] (g) | 2.56 | 1.36 | 2.02 |
| Polyvinyl Acetate Emulsion[2] (g) | 6.94 | 2.42 | 2.45 |
| Water (g) | 5.16 | 3.43 | 2.09 |

TABLE 3-continued

Formulation of Compositions 5–7

| | Formulation | | |
|---|---|---|---|
| | 5 | 6 | 7 |
| Calculated Silver Content (%) | 39.8 | 50.0 | 59.6 |

[1]Silsphere 514, commercially available from Technic, Inc.
[2]Dur-O-Set C-325

Formulations 5-7 were coated, dried, heated, and measured according to the procedure of Example 1. Table 4 shows the annealing conditions, silver content, and resistivity for samples 5-7 after annealing.

TABLE 4

Properties of Formulations 5–7 after Annealing

| Formulation | Annealing Conditions | Silver Volume Fraction (%) | Resistivity (Ω · cm) |
|---|---|---|---|
| 5 | 150° C. | 6.2 | Nonconductive |
| 5 | 170° C. | 6.2 | Nonconductive |
| 6 | 150° C. | 9.1 | Nonconductive |
| 6 | 170° C. | 9.1 | $10^{-2}$–$10^{0}$ |
| 7 | 150° C. | 12.9 | $5.4 \times 10^{-3}$ |
| 7 | 170° C. | 12.9 | $3.2 \times 10^{-3}$ |

Table 4 illustrates that when the silver particles are only slightly smaller than the polymer particles the percolation threshold of the silver particles is at least 50% by weight or about 9.1% by volume. This level is lower than the calculated value for neat spherical conductive particles dispersed in a uniform media.

Example 3. Compositions 8-10 were made according to the method of Example 1. Different polymer latices, each commercially available from Dow Chemical Company having different polymer sizes were utilized in each composition. The compositions and properties of the polymers are illustrated in Table 5.

TABLE 5

Polymer Compositions and Properties

| Polymer | Composition | Solid Content (%) | Average Particle Size (μm) | Size Ratio with Silver Nanoparticles |
|---|---|---|---|---|
| UCAR Latex 627 | Butyl acrylate, methyl methacrylate polymer; 2-ethylhexyl acrylate, methyl methacrylate polymer; water | 43 | 0.11 | 1.8 |
| UCAR Latex 452 | Acrylate based polymer; styrene-acrylate based polymer; water 50–60% | 44 | 0.25 | 4.2 |
| UCAR Latex 651 | Butyl acrylate, methyl methacrylate polymer; methacrylic acid polymer; glycols, polyethylene, mono [(1,1,3,3-tetramethyl)phenyl] ether <=2%; ammonia 0.2%; water 35% | 65 | 0.45 | 7.5 |

The ingredients of each composition are shown in Table 6.

TABLE 6

Formulation of Compositions 8–10

| | Formulation | | |
|---|---|---|---|
| | 8 | 9 | 10 |
| Nanosilver Powder[1] (g) | 1.72 | 1.76 | 1.63 |
| UCAR 627 (g) | 4.0 | — | — |
| UCAR 452 (g) | — | 4.0 | — |
| UCAR 751 (g) | — | — | 2.5 |
| Water | 1.5 | 1.6 | 2.7 |
| Calculated Silver Content (%) | 50 | 50 | 50 |

[1]Ferro Nanosilver 7000-95

Formulations 8-10 were coated, dried, heated, and measured according to the procedure of Example 1. Table 7 shows the annealing conditions, silver content, and resistivity for samples 8-10 after annealing.

TABLE 7

Properties of Formulations 8–10 after Annealing

| Formulation | Annealing Conditions | Silver Content by TGA (%) | Silver Volume Fraction (%) | Resistivity (Ω · cm) |
|---|---|---|---|---|
| 8 | 170° C. | 50.9 | 9.4 | Nonconductive |
| 9 | 170° C. | 50.8 | 9.3 | $7.3 \times 10^{2}$ |
| 10 | 170° C. | 45.7 | 7.8 | $1.8 \times 10^{2}$ |

Table 7 illustrates that the higher the size ratio between the polymer particles and the conductive particles the better the electrical conductivity after annealing with the same silver loading.

Comparative Example. Two compositions were made according to the method of Example 1. A micro silver was utilized with an average particle size in the range of about 1.3 to about 3.2 μm resulting in a polymer particle/nanosilver particle size ratio of less than one. The ingredients of each composition are shown in Table 8.

TABLE 8

Formulation of Comparative Compositions

| | Formulation | |
|---|---|---|
| | 11 | 12 |
| Microsilver Powder[1] (g) | 2.2 | 3.3 |
| Polyvinyl Acetate | 4.0 | 4.0 |

TABLE 8-continued

| Formulation of Comparative Compositions | | |
|---|---|---|
| | Formulation | |
| | 11 | 12 |
| Emulsion[2] (g) | | |
| Water (g) | 2.0 | 2.5 |
| Calculated Silver Content (%) | 49.5 | 59.6 |

[1]Silsphere 519, commercially available from Technic, Inc.
[2]Dur-O-Set C-325

Formulations 11-12 were coated, dried, heated and measured according to the procedure of Example 1. Table 9 shows the annealing conditions, silver content, and resistivity for samples 11-12 after annealing.

TABLE 9

| Properties of Formulations 11–12 after Annealing | | | |
|---|---|---|---|
| Formulation | Annealing Conditions | Silver Volume Fraction (%) | Resistivity (Ω/cm) |
| 11 | 150° C. | 8.9 | Nonconductive |
| 11 | 170° C. | 8.9 | Nonconductive |
| 12 | 150° C. | 12.9 | Nonconductive |
| 12 | 170° C. | 12.9 | Nonconductive |

The results of testing on the comparative formulations show that the percolation threshold of the conductive particles remains high when the conductive particles are larger than the polymer particles.

Many modifications and variations of this invention can be made without departing from its sprit and scope, as will be apparent to those skilled in the art. The specific embodiments described herein are offered by way of examples only, and the invention is to be limited only by the terms of the appended claims, along with the full scope and equivalents to which such claims are entitled.

We claim:

1. A curable composition consisting essentially of an aqueous polymer emulsion or a polymer particle dispersion in organic solvent, electrically conductive filler of silver or silver coated particles, and a liquid medium, wherein the average polymer particle size is larger than the average electrically conductive filler particle size wherein the size ratio between the polymer particle size and silver or silver coated particle size is about 1.5:1 to about 23:1.

2. The curable composition of claim 1, wherein the polymer particles are selected from the group consisting of polyvinyl acetate, ethylene vinyl acetate copolymers, styrene, styrene acrylate copolymers, polyurethane, rubber latexes, natural rubber, butyl rubber, styrene butadiene rubber, and copolymers and mixtures thereof.

3. The curable composition of claim 1, wherein the average size of the electrically conductive filler particles is in the range of about 5 nm to about 5 μm.

4. The curable composition of claim 3, wherein the electrically conductive particles have an average size of less than about 500 nm.

5. An electrically conductive material formed from the curable composition of claim 1.

6. An electrically conductive network structure formed from the composition of claim 1.

7. An electronic device comprising the electrically conductive composition of claim 1.

8. A transparent conductive material formed according to claim 1.

* * * * *